United States Patent [19]

Sakai et al.

[11] 4,286,042

[45] Aug. 25, 1981

[54] LIGHT REFLECTING LAYER FOR COLOR DIFFUSION TRANSFER PHOTOGRAPHIC SYSTEM

[75] Inventors: Nobuo Sakai; Hiroshi Hayashi; Masaharu Toriuchi; Kazunobu Katoh, all of Minami-ashigara, Japan

[73] Assignee: Fuji Photo Film Co., Ltd., Minami-ashigara, Japan

[21] Appl. No.: 46,127

[22] Filed: Jun. 6, 1979

[30] Foreign Application Priority Data

Jun. 6, 1978 [JP] Japan ..... 53/68198

[51] Int. Cl.[3] ..... G03C 1/40; G03C 7/00; G03C 1/10; G03C 5/54

[52] U.S. Cl. ..... 430/216; 106/137; 106/300; 252/404; 430/372; 430/551; 430/559; 430/644

[58] Field of Search ..... 96/77, 29 D, 84 R, 56; 428/538, 539, 474; 260/37 M; 252/404; 106/137, 300; 430/512, 551, 559, 372, 216, 644

[56] References Cited

U.S. PATENT DOCUMENTS

| | | | |
|---|---|---|---|
| 3,591,381 | 7/1971 | Gray et al. | 430/372 |
| 3,700,455 | 10/1972 | Ishikawa et al. | 96/56 |
| 3,801,322 | 4/1974 | Shirasu et al. | 96/56 |

FOREIGN PATENT DOCUMENTS

| | | | |
|---|---|---|---|
| 2055400 | 6/1971 | Fed. Rep. of Germany | 430/551 |

OTHER PUBLICATIONS

"Photographic Processes and Products", *Research Disclosure,* No. 15162, 11/1976, pp. 75–87.

*Primary Examiner*—Richard L. Schilling
*Attorney, Agent, or Firm*—Sughrue, Mion, Zinn, Macpeak and Seas

[57] ABSTRACT

A light reflecting layer for a color diffusion transfer photographic system which comprises at least one compound represented by the general formula (I):

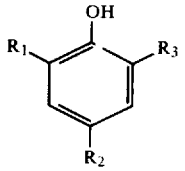

(I)

wherein $R_1$ represents an alkyl group having 1 to 9 carbon atoms, $R_2$ represents an alkyl group having 1 to 5 carbon atoms, and $R_3$ represents an alkyl group having 1 to 9 carbon atoms or a benzyl group which may be substituted at the α-position.

17 Claims, No Drawings

LIGHT REFLECTING LAYER FOR COLOR DIFFUSION TRANSFER PHOTOGRAPHIC SYSTEM

BACKGROUND OF THE INVENTION

1. Field of the Invention

The present invention relates to a method of improving the light fastness of color images formed in a color diffusion transfer photographic system.

2. Description of the Prior Art

Various types of anti-fading agents have been known for improving the light fastness of color images in the color diffusion transfer photographic system. However, they are not always completely effective. For example, a light reflecting layer containing tert-butyl hydroxyanisole has been disclosed in *Research Disclosure,* No. 15162, p. 82, but its ability to prevent light fading is not sufficient and it discolors into a yellowish brown color and contaminates the light reflecting layer when it is exposed to light for long periods of time.

It has been disclosed in U.S. Pat. No. 3,700,455 that light fading in general color photographs can be prevented by the presence of bisphenol derivatives with dyes forming the color images. It is also disclosed in that same U.S. Patent that the light fastness of color images is improved using bisphenol derivatives in the image-receiving layer used in conjunction with color diffusion transfer process. However, in the case of a color diffusion transfer process using a light reflecting layer which is laminated as shown in Belgian Pat. Nos. 757,960 and 757,959, the effect of preventing light fading of color images is insufficient if the anti-fading agent is added to the image-receiving layer (hereafter the mordant layer).

In the case of the above-described color diffusion transfer process using a light reflecting layer, it has been found that excellent light fastness can be obtained by adding a certain class of compound to the light reflecting layer as opposed to adding it to the mordant layer. This is truly an unexpected result.

SUMMARY OF THE INVENTION

An object of the present invention is to improve the light fastness of images formed by a diffusion transfer process without coloration when the materials are exposed to light for a long period of time and left in an atmosphere at a high temperature and a high humidity.

The objects of the present invention have been attained by adding at least one compound represented by the following formula (I) to the light reflecting layer of a color diffusion transfer photographic system.

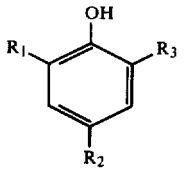

(I)

wherein $R_1$ represents an alkyl group having 1 to 9 carbon atoms, $R_2$ represents an alkyl group having 1 to 5 carbon atoms, and $R_3$ represents an alkyl group having 1 to 9 carbon atoms or a benzyl group which may be substituted at the $\alpha$-position.

DETAILED DESCRIPTION OF THE INVENTION

In the formula, $R_1$ may be a straight chain, a branched chain or a cyclic alkyl group having 1 to 9 carbon atoms. Representative examples of $R_1$ include a methyl group, an ethyl group, a tert-butyl group, a tert-octyl group, a tert-nonyl group, a cyclohexyl group, etc.

$R_2$ may be a straight chain or a branched chain alkyl group having 1 to 5 carbon atoms including substituted alkyl groups. Suitable substituents for $R_2$ include an amino group, an alkylamino group (e.g., a methylamino group, a dimethylamino group, a diethylamino group, etc.), a hydroxyl group, etc. Representative examples of $R_2$ include a methyl group, an ethyl group, a hydroxymethyl group, an aminomethyl group, a diethylaminomethyl group, a dimethylaminomethyl group, etc.

$R_3$ may be a straight chain or a branched chain alkyl group having 1 to 9 carbon atoms or a benzyl group including substituted benzyl groups. Representative examples of alkyl groups in $R_3$ include those described in $R_1$. The benzyl group may be substituted by a hydroxyl group, a straight or branched chain alkyl group having 1 to 9 carbon atoms [which may be substituted with an amino group, an alkylamino group (examples of which are described above) or a hydroxyl group] or a cycloalkyl group having 4 to 9 carbon atoms. Suitable examples of substituents for the benzyl group include a methyl group, an ethyl group, a tert-butyl group, a tert-octyl group, a tert-nonyl group, a diethylaminomethyl group, a hydroxymethyl group, a cyclopentyl group, a cyclohexyl group, etc.

The carbon atom at the $\alpha$-position of the benzyl group may be substituted with a straight or branched chain alkyl group having 1 to 5 carbon atoms or a cycloalkyl group having 3 to 5 carbon atoms.

Representative examples of the $R_3$ benzyl group

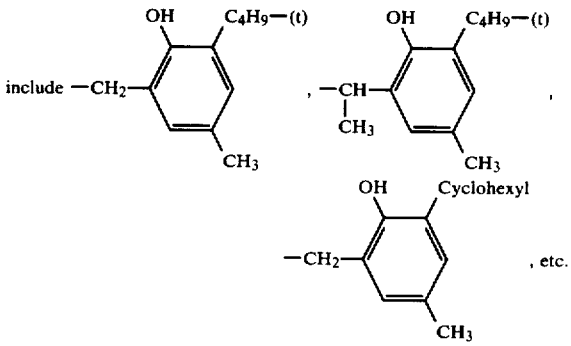

Among the compounds represented by the formula (I), compounds represented by the following formula (II) are particularly preferred for the present invention.

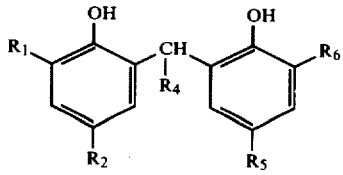

(II)

In formula (II), $R_1$ and $R_2$ have the same definition as in the formula (I). $R_4$ represents a hydrogen atom, a straight or branched chain alkyl group having 1 to 5 carbon atoms (e.g., a methyl group, a propyl group or a butyl group) or a cycloalkyl group having 3 to 5 carbon atoms (e.g., a cyclo pentyl group, etc.). $R_5$ and $R_6$ have the same definition as $R_2$ and $R_1$ respectively in formula (I) but may be the same or different than $R_2$ and $R_1$.

Examples of the compounds represented by the formula (I) include the following.

I-1

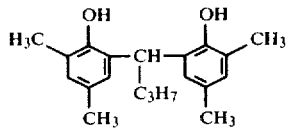

I-2

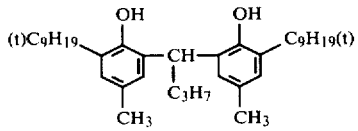

I-3

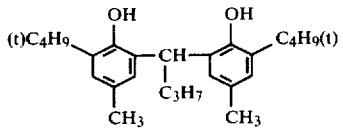

I-4

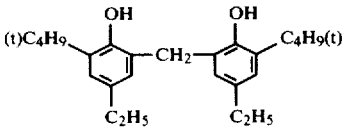

I-5

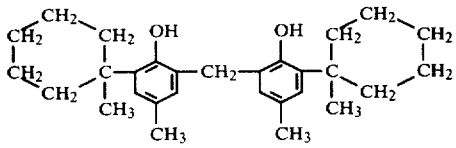

I-6

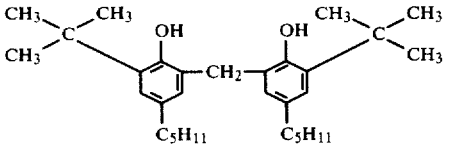

I-7

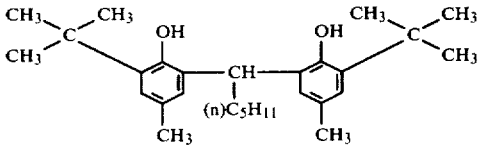

I-8

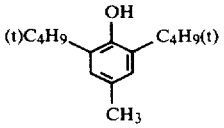

I-9

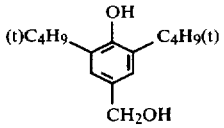

I-10

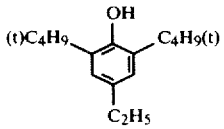

I-11

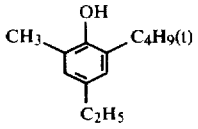

-continued

I-12

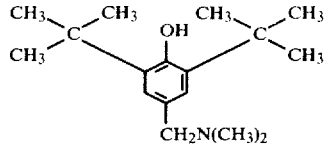

I-13

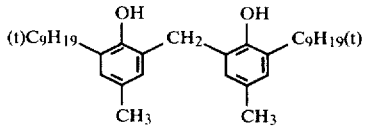

The light reflecting layer is used to provide white color in the non-image areas so that the images obtained in the color diffusion transfer system are visible by reflected light.

The light reflecting layer contains pigments which give it its white color. Suitable pigments for the light reflecting layer are barium sulfate, zinc oxide, barium stearate, silver flakes, silicates, alumina, zirconium oxide, zirconium sodium sulfate, kaolin, mica and titanium dioxide. They may be dispersed alone or they may be used in a mixture by mixing in a ratio for obtaining the desired light reflectance. These pigments are dispersed in suitable binders such as an alkali permeable high molecular matrix such as gelatin, polyvinyl alcohol or cellulose derivatives such as hydroxyethyl cellulose or carboxymethyl cellulose.

A particularly preferred pigment is titanium dioxide. As the titanium dioxide, various types of pigments available in the market can be used. Among them, it is particularly preferred to use rutile-type titanium dioxide.

Though the whiteness of the light reflecting layer varies with the pigment, the ratio of the pigment to the binder, and the amount of the pigment, it is preferably selected such that the light reflectance of the layer is 70% or more. Generally, the whiteness increases as the amount of the pigment increases. However, since the pigment is also a barrier to diffusion when image forming dyes diffuse to the reflecting layer, it is preferably applied in a suitable amount. The pigment is generally applied in an amount of about 5 to 40 g/m$^2$ and preferably about 10 to 25 g/m$^2$ to form a light reflecting layer having about 78 to 85% of the light reflectance at 540 nm.

For many available pigments, surface treatment with alumina, silica or zinc oxide, etc., as described in *Pigment Handbook*, Vol. III, pp. 173–174, published by John Wiley & Sons, etc., is carried out. In order to obtain high reflectance, it is preferred that the surface treatment is carried out in a degree of 5% or more. As titanium dioxide available in the market, there are, for example, Ti-pure R 931 produced by Du Pont de Nemours E.I., and materials described in *Research Disclosure*, 15162.

As the binder for the light reflecting layer, gelatin is suitably used. A useful ratio of pigment to binder is about 1/1 to 20/1 (by weight) and preferably about 5/1 to 10/1 by weight.

As dispersing agents for dispersing the pigment used for the light reflecting layer of the color diffusion transfer photographic element, it is possible to use materials described in *Research Disclosure*, 15162, in addition to the following materials. They may be used alone or in combination. Particularly preferred dispersing agents are anionic materials and, particularly, condensation products of formaldehyde and naphthalene sulfonic acid such as Tamol (Rohm & Haas Co.). Suitable agents include: Aerosol OT (American Cyanamid Co.), Tamol 850 (Rohm & Haas Co.), Demor N (Kao Soap Co.), and Alkanol XC.

Further, alkali metal salts of phosphoric acid such as sodium hexametaphosphate and cellulose derivatives such as hydroxyethyl cellulose or carboxymethyl cellulose may be used as dispersing agents as described in *J. Paint Technology*, Vol. 46, Issue No. 594, p. 51 (1974).

In order to produce the light reflecting layer, the white pigments are added to an aqueous solution containing a dispersing agent and dispersed therein. The resulting dispersion is then mixed with a solution of a binder, for example, gelatin. In addition, it is possible to incorporate, if necessary, stilbene, coumarin, triazine or oxazole type fluorescent whitening agents in the light reflecting layer in order to improve the whiteness of the layer or to add polymer latexes as described in U.S. Pat. Nos. 3,287,289, 3,411,911, 3,488,708, etc., to the layer in order to reduce brittleness of the light reflecting layer.

The light reflecting layer can be obtained by applying a dispersion of the pigments which contains coating assistants known in the art, such as surface active agents, hardening agents or viscosity increasing agents, by the known application means.

The compounds of the present invention can be incorporated in the light reflecting layer by various known means. For example, it is possible to use a process which comprises dissolving the compounds in an organic solvent having a low boiling point such as acetone and adding the resulting solution to a dispersion of white pigments, a process which comprises dissolving the compounds in an oil such as diethyl laurylamide and dispersing the oil in gelatin, a process which comprises adding the compounds to an organic polymer latex which is a dispersion of an organic polymer in water and allowing them to be contained on the wetted surface of particles of the organic polymer as described in German Patent Application (OLS) No. 2,541,274, or a process which comprises dispersing the compounds by mixing with white pigments directly.

Though the optimum amount of compound of formula (I) added to the light reflecting layer in accordance with the present invention varies depending on the compound, it is generally about 0.05 g/m$^2$ to 3.0 g/m$^2$ and preferably about 0.15 g/m$^2$ to 1.2 g/m$^2$. The efects of the addition are unexpected. Namely, in case of using a certain compound as an anti-fading agent, it has so far been believed that the most notable effect is shown when the compound is present together with the color images, that is, in the emulsion layer in the case of a color photographic paper or in conventional color positive or color negative films in the mordant layer of a diffusion transfer material. However, in the color diffusion transfer photographic system having the light reflecting layer, the fade preventing effect is larger when the compounds of formula (I) are present in the light reflecting layer adjacent to the mordant layer rather than when they are present in the mordant layer.

When the light reflecting layer containing the compounds represented by the formula (I) is combined in a laminated color diffusion transfer photographic system for negative image receiving, the effect of the present invention is further enhanced.

As color dye-image forming substances for the diffusion transfer process of the present invention, it is possible to use compounds described in, for example, U.S. Pat. Nos. 3,227,551, 3,227,554, 3,443,939, 3,443,940, 3,658,524, 3,698,897, 3,725,062, 3,728,113, 3,751,406, 3,929,760, 3,931,144 and 3,932,381, British Pat. Nos. 840,731, 904,364 and 1,038,331, German Patent Application (OLS) Nos. 1,930,215, 2,214,381, 2,228,361, 2,242,762, 2,317,134, 2,402,900, 2,406,626 and 2,406,653, Japanese Patent Application (OPI) Nos. 114424/74, 126332/74, 33826/73, 126331/74, 115528/75, 113624/76, 104343/76, 8827/77, 106727/77, 114930/76, 23628/78, and 149328/78, 8627/79 and 65034/79. Particularly, it is preferred to use color image forming substances which are nondiffusible at first but release a diffusible dye by an oxidation-reduction reaction with an oxidation product of the developing agent (hereinafter, they are called DRR compounds).

Examples of the DRR compounds include 1-hydroxy-2-tetramethylenesulfamoyl-4-[3'-methyl-4'-(2''-hydroxy-4''-methyl-5''-hexadecyloxyphenylsulfamoyl)phenolazo]naphthalene as a magenta image forming substance and 1-phenyl-3-cyano-4-{3'-[2''-hydroxy-4''-methyl-5''-(2''',4'''-di-t-pentylphenoxyacetamido)-phenylsulfamoyl]phenylazo{-5-pyrazolone as a yellow image forming substance besides compounds described in the above-described patent specifications.

In case of using the DRR compound in the present invention, any silver halide developing agent may be used, if it is capable of oxidizing the DRR compound. Such a developing agent may be incorporated in an alkaline processing composition (processing element) or may be incorporated in a suitable layer of the photosensitive element. Examples of the developing agents suitable for use in the present invention are as follows.

Hydroquinone, aminophenols, for example, N-methylaminophenol, 1-phenyl-3-pyrazolidone, 1-phenyl-4,4-dimethyl-3-pyrazolidone, 1-phenyl-4-methyl-4-oxymethyl-3-pyrazolidone, N,N-diethyl-p-phenylenediamine, 3-methyl-N,N-diethyl-p-phenylenediamine and 3-methoxy-N-ethoxy-p-phenylenediamine.

Among the above-described compounds, black and white developing agents which have a property of reducing stain formation on the image receiving layer (mordant layer) are particularly preferred.

In the case of using DRR compounds in the present invention, if so-called normal type emulsions in which development is carried out proportionate to the degree of exposure are used, the transfer images are negative images and the remaining images are positive images. On the other hand, if the so-called direct reversal silver halide emulsions in which silver halide in unexposed areas is developed (for example, inner latent image type emulsions or solarization type emulsions, etc.) are used, positive images are formed on the image receiving member of the film unit.

The color developing agent may be incorporated in another layer provided on a negative part of the film unit or it may be incorporated in the same silver halide emulsion layer.

The processing composition used in the present invention is a liquid composition containing components necessary to develop the silver halide emulsion and to form diffusion transfer dye images in which the solvent is composed of water as a main component and, if necessary, hydrophilic solvents such as methanol or methyl cellosolve. The processing composition contains alkali in an amount necessary to maintain the pH required for carrying out development of the emulsion layer and to neutralize acids formed during the steps of development and dye image formation (for example, hydrohalogenic acids such as hydrobromic acid or carboxylic acids such as acetic acid, etc.). As alkalis used, there are alkali metal salts, alkaline earth metal salts and amines such as lithium hydroxide, sodium hydroxide, potassium hydroxide, calcium hydroxide (dispersion), tetramethyl ammonium hydroxide, sodium carbonate, sodium tertiary phosphate or diethylamine, etc. It is particularly preferred to add caustic alkali in a concentration so as to obtain a pH of about 10 or more and preferably about 12 or more at room temperature.

It is further preferred that the processing composition contains high molecular weight hydrophilic polymers such as polyvinyl alcohol, hydroxyethyl cellulose or sodium carboxymethyl cellulose. These polymers not only produce 1 poise or more of the viscosity and preferably several hundreds (500–600) to 1,000 poises viscosity at room temperature, by which the processing composition can be easily spread uniformly at processing, but also they form a non-fluidized film when processing components are condensed by movement of the aqueous solvent into the sensitive element and the image receiving element during the processing step to assist in unification of the film unit after processing. This polymer film can be utilized for inhibiting further movement of coloring components into the image receiving layer to prevent deterioration of images after formation of the diffusion transfer dye images is substantially finished.

It is sometimes advantageous that the processing composition contain light intercepting substances such as $TiO_2$, carbon black or pH indicating dyes or desensitizers as described in U.S. Pat. No. 3,579,333 in order to prevent fogging of silver halide emulsions by external light. Further, restrainers such as benzotriazole may be added to the processing composition. Generally, the above-described processing composition is used in a destructible container as described in U.S. Pat. Nos. 2,543,181, 2,643,886, 2,653,732, 2,723,051, 3,056,491, 3,056,492 and 3,152,515.

The photographic film unit according to the present invention, namely, the film unit which is processed by passing through a pair of pressing members laid in parallel, comprises, in addition to the above-described light-reflecting layer, a photosensitive element, an image receiving element containing a polymer mordant, and a means such as a destructible container for discharging an alkaline processing composition containing a silver halide developing agent in the film unit.

The photosensitive element in the above-described film unit is placed on the image receiving element in a face-to-face relation after exposure to light and processing by spreading the alkaline processing composition between both elements. In this case, the image receiving element may be separated after image transfer or the images may be observed without separating the image receiving element as described in U.S. Pat. No. 3,415,645.

In a particularly preferred embodiment, the image receiving layer in the above-described film unit may be present in one unit together with the base and the photosensitive silver halide emulsion layers. For example, as disclosed in Belgian Pat. No. 757,960, materials which are prepared by applying an image receiving layer, a substantially opaque light reflecting layer (containing the compound of formula (I) in the present invention) and photosensitive layers composed of one or more photosensitive elements on a transparent base are preferred. After the photosensitive elements are exposed to light, an opaque cover sheet is placed thereon in a face-to-face relation, and the processing composition is spread between them.

Another embodiment applicable to the present invention which is a laminated unified film unit has been described in Belgian Pat. No. 757,959. In this embodiment, an image receiving layer, a substantially opaque light reflecting layer (in which in this invention the compound of formula (I) is present) and the above-described one or more photosensitive layers are applied on a transparent base and a transparent cover sheet is put thereon in a face-to-face relation. A destructible container filled with an alkaline processing composition containing an opaque agent (for example, carbon black) is disposed so as to be adjacent to the uppermost layer of the above-described photosensitive layers and the transparent top sheet. When this film unit is taken out from the camera after exposure through the transparent cover sheet, the container is broken by pressing members to spread the processing composition (containing the opaque agent) between the photosensitive layers and the cover sheet. Thus, the film unit is shielded from light and development proceeds.

Further, other laminated unification type embodiments employing DRR compounds or diffusible dye releasing (DRR) couplers can be used in the present invention as described in U.S. Pat. Nos. 3,415,644, 3,415,645, 3,415,646, 3,647,487 and 3,635,707 and German Patent Application (OLS) No. 2,426,980.

EXAMPLE 1

Image receiving elements (A) to (G) in which the following layers (1), (2) and (3) were applied to a transparent polyethylene terephthalate support were prepared.

Layer (1):

A mordant layer containing 3.0 g/m$^2$ of the following mordant and 3.0 g/m$^2$ of gelatin.

Mordant:

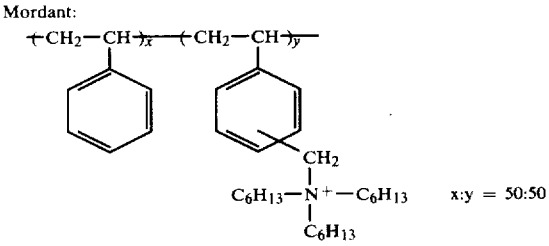

Layer (2):

A light reflecting layer containing 17.6 g/m$^2$ of titanium oxide, 2.5 g/m$^2$ of gelatin and the compound shown in the Table 1 below dispersed by emulsifying the compound in an equal amount of diethyl laurylamide.

TABLE 1

| Image Receiving Element | Compound | Amount |
|---|---|---|
| | | (g/m$^2$) |
| A | (3) | 0.6 |
| B | (13) | 0.6 |
| C | (5) | 0.6 |
| D | (4) | 0.6 |
| E | (8) | 0.6 |
| F | (9) | 0.6 |
| G | None | — |

TABLE 1-continued

| Image Receiving Element | Compound | Amount |
|---|---|---|
| H | tert-Butylhydroxy-anisole | 0.6 |

Layer (3):

A layer of 8 g/m$^2$ of gelatin.

The above-described image receiving elements were dyed with the following cyan dye so that a reflection density was 1.5. Dye residual ratios after exposure to light for 1 week by a fluorescent lamp at 17,000 lux are shown in Table 2. Cyan Dye:

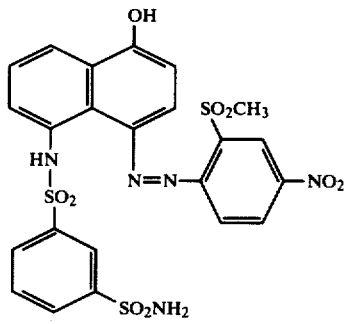

TABLE 2

| Image Receiving Element | Dye Residual Ratio |
|---|---|
| A Invention | 82 |
| B " | 80 |
| C " | 78 |
| D " | 84 |
| E " | 69 |
| F " | 60 |
| G Blank | 39 |
| H Comparison | 45 |

The above results demonstrate that the light fastness of the dye is improved by incorporating compounds of the formula (I) in a light reflecting layer in accordance with the present invention.

Further, when reflection absorption spectra of the samples in this example were measured by the Hitachi 323 Type spectrophotometer after exposure to light for 1 week by a fluorescent lamp at 17,000 lux and allowed to stand for 5 days under a condition at 50° C. and 80% R.H., the absorption curves were not changed by the lapse of time and coloring was not observed.

On the other hand, in the comparison example, the light fastness was less improved as compared with the cases of using compounds of the present invention, and coloring in yellowish brown color was observed.

EXAMPLE 2

Image receiving elements (A-S) and (C-S) were prepared by the same manner as image receiving element (A) in Example 1 except that a solution of the compound (3) and (5) respectively in acetone was added to the mordant layer instead of the light reflecting layer. They were processed by the same manner as in Example 1, and the fading test was carried out. The results obtained are shown in Table 3.

TABLE 3

| Image Receiving Element | | Dye Residual Ratio |
|---|---|---|
| (A) | Invention | 82 |
| (A-S) | Comparison | 55 |
| (C) | Invention | 78 |
| (C-S) | Comparison | 54 |

It is understood from the above results that the light fastness of the dye is improved more in the case in which the compounds of the formula (I) are added to the light reflecting layer than in the case of adding the compounds to the mordant layer.

EXAMPLE 3

The following layers (1) to (12) were applied to a transparent polyethylene terephthalate base in this order to prepare a photosensitive sheet (I).

(1) A mordant layer containing 3.0 g/m$^2$ of the mordant in Example 1 and 3.0 g/m$^2$ of gelatin.

(2) A light reflecting layer containing 17.6 g/m$^2$ of titanium oxide, 2.5 g/m$^2$ of gelatin, 0.18 g/m$^2$ of 2,6-di-tert-butyl-4-methylphenol, 0.42 g/m$^2$ of 2,2'-butylidene-bis(6-tert-butyl-4-methylphenol) and 0.6 g/m$^2$ of diethyllaurylamide.

(3) A light intercepting layer containing 2.70 g/m$^2$ of carbon black and 2.70 g/m$^2$ of gelatin.

(4) A layer containing the following cyan image forming substance (0.50 g/m$^2$), diethyl laurylamide (0.25 g/m$^2$) and gelatin (1.14 g/m$^2$).

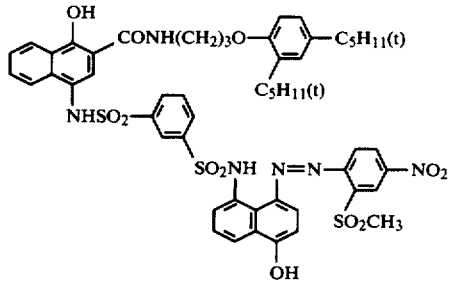

(5) A layer containing a red-sensitive internal latent image type direct reversal silver iodobromide emulsion (halogen composition in silver halide: 2 mol% of iodine, amount of silver: 1.9 g/m$^2$, and gelatin: 1.4 g/m$^2$), a fogging agent represented by the following formula (0.028 g/m$^2$)

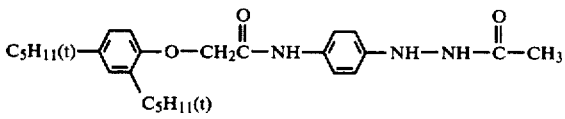

and sodium pentadecylhydroquinone sulfonate (0.13 g/m$^2$).

(6) A layer containing gelatin (2.6 g/m$^2$) and 2,5-dioctylhydroquinone (1.0 g/m$^2$). (7) A layer containing the following magenta image forming substance (0.45 g/m$^2$), diethyllaurylamide (0.10 g/m$^2$), 2,5-di-tert-butylhydroquinone (0.0074 g/m$^2$) and gelatin (0.76 g/m$^2$).

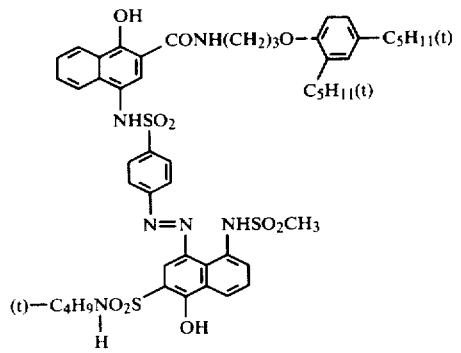

(8) A layer containing a green-sensitive internal latent image type direct reversal silver iodobromide emulsion (halogen composition of silver iodobromide: 2 mol% iodine, amount of silver: 1.4 g/m$^2$, gelatin: 1.0 g/m$^2$), the same fogging agent as that added to layer (5) (0.024 g/m$^2$) and sodium pentadecylhydroquinone sulfonate (0.11 g/m$^2$).

(9) A layer containing gelatin (2.6 g/m$^2$) and 2,5-di-octylhydroquinone (1.0 g/m$^2$).

(10) A layer containing the following yellow image forming substance (0.78 g/m$^2$), diethyllaurylamide (0.16 g/m$^2$), 2,5-di-t-butylhydroquinone (0.012 g/m$^2$) and gelatin (0.78 g/m$^2$).

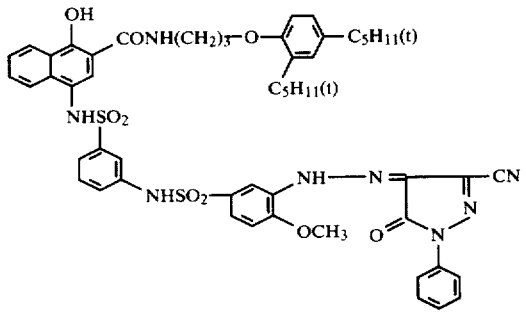

(11) A layer containing a blue-sensitive internal latent image type direct reversal silver iodobromide emulsion (halogen composition of silver iodobromide: 2 mol% of iodine, amount of silver: 2.2 g/m$^2$, gelatin: 1.7 g/m$^2$), the same fogging agent as that added to the layer (5) (0.020 g/m$^2$) and sodium pentadecylhydroquinone sulfonate (0.094 g/m$^2$).

(12) A layer containing gelatin (0.94 g/m$^2$).

Further, photosensitive sheets (II) and (III) were prepared by the same manner as in photosensitive sheet (I) except that the layer (2) in the photosensitive sheet (I) contained 17.6 g/m$^2$ of titanium oxide and 2.5 g/m$^2$ of gelatin in the case of sheet (II) and 17.6 g/m$^2$ of titanium oxide, 2.5 g/m$^2$ of gelatin, 0.6 g/m$^2$ of tert-butylhydroxyanisole and 0.6 g/m$^2$ of diethyllaurylamide in the case of sheet (III).

Cover Sheet:

A cover sheet was prepared by applying 15 g/m$^2$ of polyacrylic acid (10 wt% aqueous solution having about 1,000 cp of the viscosity) as a neutralization acid polymer layer to a polyethylene terephthalate base and applying 3.8 g/m$^2$ of acetyl cellulose (100 g of acetyl cellulose was hydrolyzed to form 39.4 g of acetyl group) and 0.2 g/m$^2$ of poly(styrenemaleic acid anhydride) (ratio of component:styrene:maleic acid anhydride=about 60:40, molecular weight: about 50,000) as a neutralization timing layer to the resulted layer.

Processing:

The above-described cover sheet was superposed on the above-described photosensitive sheet (I), (II) or (III). After exposure to white light at the cover sheet side, the following processing solution was spread between both sheets so as to be 85$\mu$ of the thickness (the spreading was carried out by means of pressing rolls). The processing was carried out at 25° C.

| Processing Solution: | |
|---|---|
| 1-Phenyl-4-methyl-4-hydroxymethyl-3-pyrazolidinone | 10 g |
| Methylhydroquinone | 0.18 g |
| 5-Methylbenzotriazole | 4.0 g |
| Sodium Sulfite (anhydrous) | 1.0 g |
| Carboxymethylcellulose Na Salt | 40.0 g |
| Carbon Black | 150 g |
| Potassium Hydroxide (28% aq. soln.) | 200 cc |
| $H_2O$ | 550 cc |

After having carried out the spreading treatment, the sheets were allowed to stand for 2 weeks at 35° C. and 10% R.H. to dry.

The photosensitive sheets were exposed to light for 7 days by a fluorescent lamp at 17,000 lux, and density decrease of areas, the initial reflection density of which were 1.5, were measured.

Residual ratios of magenta and cyan colors are shown in Table 4.

It is understood that the dye image preservation stability of the photosensitive sheet (I) according to the present invention is excellent as compared with that of the photosensitive sheets (II) and (III).

Further, in the photosensitive sheet (III), yellowish brown stains were observed in highlight areas, and cyan images became reddish to remarkably deteriorate quality of images.

TABLE 4

| Photosensitive Sheet | Dye Residual Ratio (%) Magenta | Cyan |
|---|---|---|
| (I) | 92 | 85 |
| (II) | 75 | 45 |
| (III) | 80 | 55 |

While the invention has been described in detail and with reference to specific embodiments thereof, it will be apparent to one skilled in the art that various changes and modifications can be made therein without departing from the spirit and scope thereof.

What is claimed is:

1. A light reflecting element for a color diffusion transfer photographic system which comprises a supporting material having thereon a layer comprising a white pigment dispersed in a binder and additionally containing at least one compound represented by the formula (I):

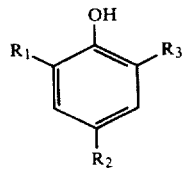

(I)

wherein $R_1$ represents an alkyl group having 1 to 9 carbon atoms, $R_2$ represents an alkyl group having 1 to 5 carbon atoms, and $R_3$ represents an alkyl group having 1 to 9 carbon atoms or a benzyl group.

2. The light reflecting element of claim 1, wherein said compound represented by the formula (I) is represented by the formula (II):

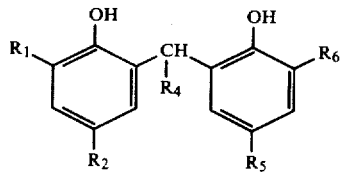

(II)

wherein $R_1$ and $R_2$ have the same definition as in formula (I), $R_5$ and $R_6$ have the same definition as $R_2$ and $R_1$, respectively, and $R_4$ represents a hydrogen atom or an alkyl group.

3. The light reflecting element of claim 1 or 2, wherein said white pigment is titanium dioxide.

4. The light reflecting element of claim 3, wherein said binder is gelatin.

5. The light reflecting element of claims 1 or 2, wherein said layer has a reflectivity greater than about 70%.

6. The light reflecting element of claims 1 or 2, wherein said compound represented by the formula (I) is present in said layer in an amount of about 0.05 g/m$^2$ to 3.0 g/m$^2$.

7. The light reflecting element of claim 1, wherein the ratio of said pigment to said binder is about 1:1 to 20:1 by weight.

8. In a diffusion transfer color photographic material comprising a photosensitive element containing at least one silver halide photographic emulsion and at least one dye image forming material, an image receiving element and means for discharging an alkaline processing solution containing a silver halide development agent and a light reflecting layer comprising a white pigment dispersed in a binder and additionally containing at least one compound represented by the formula (I):

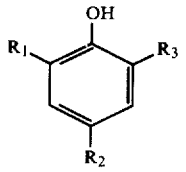

(I)

wherein $R_1$ represents an alkyl group having 1 to 9 carbon atoms, $R_2$ represents an alkyl group having 1 to 5 carbon atoms, and $R_3$ represents an alkyl group having 1 to 9 carbon atoms or a benzyl group.

9. The diffusion transfer element of claim 7, wherein said compound represented by the formula (I) is represented by the formula (II):

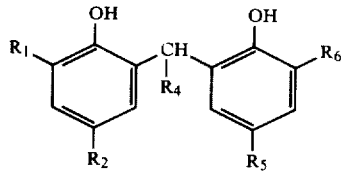

(II)

wherein $R_1$ and $R_2$ have the same definition as in formula (I), $R_5$ and $R_6$ have the same definition as $R_2$ and $R_1$, respectively, and $R_4$ represents a hydrogen atom or an alkyl group.

10. The diffusion transfer element of claim 8 or 9, wherein said white pigment is titanium dioxide.

11. The diffusion transfer element of claim 10, wherein said binder is gelatin.

12. The diffusion transfer element of claims 8 or 9, wherein said light reflecting layer has a reflectivity of at least about 70%.

13. The diffusion transfer element of claims 8 or 9, wherein said element forms negative images.

14. The light reflecting element of claim 1, wherein said compound is

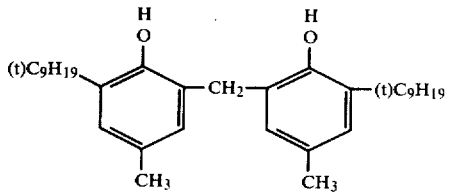

15. The light reflecting element of claim 1 wherein said compound is

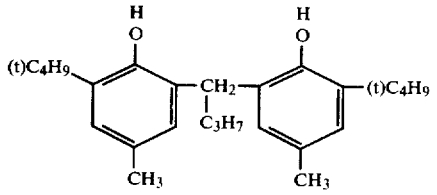

16. The diffusion transfer element of claim 9, wherein said compound is

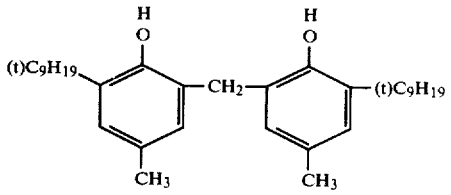

17. The diffusion transfer element of claim 9, wherein said compound is

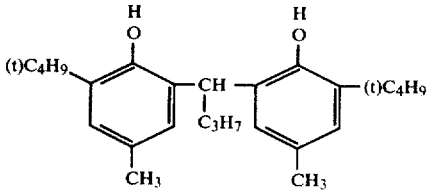

* * * * *